US010532247B2

(12) United States Patent
Coray et al.

(10) Patent No.: US 10,532,247 B2
(45) Date of Patent: Jan. 14, 2020

(54) EXERCISE DEVICE

(71) Applicants: Robert Coray, Rexburg, ID (US); Jared Ollerton, Rexburg, ID (US)

(72) Inventors: Robert Coray, Rexburg, ID (US); Jared Ollerton, Rexburg, ID (US)

( * ) Notice: Subject to any disclaimer, the term of this patent is extended or adjusted under 35 U.S.C. 154(b) by 117 days.

(21) Appl. No.: 15/972,954

(22) Filed: May 7, 2018

(65) Prior Publication Data

US 2018/0326256 A1 Nov. 15, 2018

Related U.S. Application Data

(60) Provisional application No. 62/504,589, filed on May 11, 2017.

(51) Int. Cl.

| | |
|---|---|
| ***A63B 22/04*** | (2006.01) |
| ***A63B 71/06*** | (2006.01) |
| ***A63B 22/02*** | (2006.01) |
| ***A63B 71/00*** | (2006.01) |
| ***A63B 24/00*** | (2006.01) |
| ***A63B 69/00*** | (2006.01) |
| ***A63B 71/02*** | (2006.01) |

(52) U.S. Cl.

CPC ..... *A63B 22/04* (2013.01); *A63B 22/025* (2015.10); *A63B 24/0087* (2013.01); *A63B 69/0057* (2013.01); *A63B 71/0036* (2013.01); *A63B 71/0622* (2013.01); *A63B 2071/0072* (2013.01); *A63B 2071/0081* (2013.01); *A63B 2071/025* (2013.01); *A63B 2071/0658* (2013.01); *A63B 2071/0675* (2013.01); *A63B 2220/62* (2013.01); *A63B 2225/682* (2013.01); *A63B 2230/06* (2013.01); *A63B 2230/75* (2013.01)

(58) Field of Classification Search

CPC . A63B 22/04; A63B 69/0057; A63B 71/0622; A63B 22/025; A63B 71/0036; A63B 24/0087; A63B 2071/0675; A63B 2071/025; A63B 2230/75; A63B 2071/0072; A63B 2220/62; A63B 2225/682; A63B 2071/0081; A63B 2071/0658; A63B 2230/06

See application file for complete search history.

(56) References Cited

U.S. PATENT DOCUMENTS 3,592,466 A * 7/1971 Parsons ..... A63B 22/0023 482/53

4,496,147 A * 1/1985 DeCloux ..... A63B 21/0083 482/113

(Continued)

*Primary Examiner* — Garrett K Atkinson

(74) *Attorney, Agent, or Firm* — Global Intellectual Property Agency, LLC; Daniel Boudwin

(57) ABSTRACT

An exercise device. The exercise device includes a housing having a pair of sidewalls, wherein a rear end of the pair of sidewalls has a greater height than a front end thereof, such that the housing includes an angled upper side. A belt is disposed within the housing and is connected to a motor such that the belt can rotate within the housing. A plurality of steps are affixed to the belt such that the plurality of steps extend through the angled upper side of the housing to create a staircase effect. A pair of rails extend from an upper end of each of the pair of sidewalls to form handrails for gripping purposes. An arm is pivotably connected to one of the rails such that the arm is dampened by pneumatic pressure about the pivot point.

17 Claims, 4 Drawing Sheets

(56) References Cited

U.S. PATENT DOCUMENTS 4,708,338 A * 11/1987 Potts ..... A63B 21/023 482/52
4,726,581 A * 2/1988 Chang ..... A63B 22/04 482/113
5,139,470 A * 8/1992 Wang ..... A63B 21/0083 482/113
5,207,621 A * 5/1993 Koch ..... A63B 22/0056 482/112
5,242,341 A * 9/1993 Yeh ..... A63B 22/04 482/52
5,403,252 A * 4/1995 Leon ..... A61B 5/221 482/5
5,769,759 A * 6/1998 Alter ..... A63B 22/04 482/37
6,036,622 A * 3/2000 Gordon ..... A63B 21/154 482/51
7,594,877 B2 * 9/2009 Anderson ..... A63B 21/154 482/51
7,815,549 B2 * 10/2010 Crawford ..... A63B 24/0087 482/52
7,887,464 B1 * 2/2011 Jones ..... A61H 1/0214 482/51
7,927,257 B2 * 4/2011 Patel ..... A63B 21/00181 482/142
8,277,366 B2 * 10/2012 Savane ..... A63B 22/0056 482/112
8,702,571 B2 * 4/2014 Fenster ..... A63B 22/04 482/52
8,974,353 B2 * 3/2015 Fenster ..... A63B 22/04 482/52
9,216,317 B2 * 12/2015 Golen, Jr. ..... A63B 22/04
9,238,158 B2 * 1/2016 Strommen ..... A63B 22/04
9,370,680 B1 * 6/2016 Macaulay ..... A63B 21/0552
9,789,355 B1 * 10/2017 Lo ..... A63B 22/04
9,993,682 B2 * 6/2018 Johnson ..... A63B 21/0051
10,105,568 B2 * 10/2018 Golen, Jr. ..... A63B 22/04
RE47,331 E * 4/2019 Fenster ..... A63B 22/04
2010/0099541 A1 * 4/2010 Patel ..... A63B 21/00181 482/52
2011/0177917 A1 * 7/2011 Patel ..... A63B 21/00181 482/52
2012/0238409 A1 * 9/2012 Halsey ..... A63B 22/04 482/52
2012/0264572 A1 * 10/2012 Fenster ..... A63B 22/04 482/52
2015/0165263 A1 * 6/2015 Golen, Jr. ..... A63B 22/04 482/7
2015/0190671 A1 * 7/2015 Golen, Jr. ..... A63B 22/04 482/52
2019/0022455 A1 * 1/2019 Kueker ..... A63B 21/0058

* cited by examiner

EXERCISE DEVICE

CROSS REFERENCE TO RELATED APPLICATIONS

This application claims the benefit of U.S. Provisional Application No. 62/504,589 filed on May 11, 2017. The above identified patent application is herein incorporated by reference in its entirety to provide continuity of disclosure.

BACKGROUND OF THE INVENTION

The present invention relates to an exercise device. Specifically, it relates to an exercise device comprising a stair descending apparatus having a pneumatically dampened arm extending between a pair of handrails.

Many people use exercise machines, including stair-climbers that allow a user to climb stairs at varying speeds to exercise. However, in order to exercise alternate muscle groups, a user may desire to descend the stairs instead of climbing them. Utilizing traditional stair-climber machines, a user s required to turn around or walk sideways, which presents several opportunities for injury. The user is liable to fall due to balance issues caused by the unusual or uncomfortable feeling walking backwards down stairs provides. Furthermore, a user may be required to perform specific exercises based on conditions or previous injuries that user has suffered, such as iliotibial band syndrome or those recovering from hip and knee replacement surgery. These users are typically advised to climb and descend stairs to exercise and stretch the affected areas, however supervision is typically required to use traditional stairs for exercise as a user with these conditions is in a precarious state that could easily be worsened due to a fall or other complication. Additionally, traditional stairs have limited safety features, leading to even more risk of fall. Therefore, an exercise that allows a user to safely descend stairs is desired.

In light of the devices disclosed in the known art, it is submitted that the present invention substantially diverges in design elements from the known art and consequently it is clear that there is a need in the art for an improvement to existing exercise devices. In this regard, the instant invention substantially fulfills these needs.

SUMMARY OF THE INVENTION

In view of the foregoing disadvantages inherent in the known types of exercise devices now present in the known art, the present invention provides an exercise device wherein the same can be utilized for providing convenience for the user when exercising by descending a staircase.

The present system comprises a housing having a pair of sidewalls, wherein a rear end of the pair of sidewalls comprises a greater height than a front end of the pair of sidewalls. A belt is disposed within the housing, wherein the belt is operably connected to a motor, wherein the motor is configured to rotate the belt within the housing. A plurality of steps are affixed to the belt, wherein the plurality of steps extend through the housing along an upper side thereof. A pair of rails extend from an upper end of each of the pair of sidewalls, wherein the pair of rails are configured to provide a gripping surface. An arm is pivotably affixed to one of the pair of rails at a proximal end thereof, wherein a distal end of the arm is removably securable to the opposing rail. Rotation of the arm about the proximal end is dampened by pneumatic pressure therein. In some embodiments, at least one safety rail is disposed between the pair of rails at a rear side thereof. In another embodiment, the safety rail comprises an arcuate shape. In other embodiment, the safety rail comprises a padded covering thereon. In yet another embodiment, the pair of rails comprise a padded covering thereon. In some embodiments, a computer is disposed on the arm, wherein the computer includes a display and controls thereon, the controls configured to adjust the rate at which the belt rotates. In another embodiment, each of the plurality of steps comprise an upper surface and a front wall, wherein the front wall extends perpendicularly between the upper face of one of the plurality of steps towards the upper surface of an adjacent step. In other embodiments, an upper surface of each of the plurality of steps is disposed at a different height when the plurality of steps are exposed from the housing. In yet another embodiment, a first end of the belt is disposed at a height greater than a second end of the belt. In some embodiments, each of the pair of rails comprises an emergency stop button disposed on opposing ends thereof, wherein the emergency stop button is configured to stop the rotation of the belt when the emergency stop button is actuated. In another embodiment, the distal end of the arm comprises a C-shaped clamp configured to removably secure to one of the pair of rails via friction fit. In other embodiments, a container is removably securable to the pair of rails, wherein the container includes an open upper end configured to receive a beverage container therein. In yet another embodiment, a heartrate sensor is disposed within the pair of rails, the heartrate sensor configured to detect a heartrate of a user gripping the rail, wherein the heartrate is then displayed on the display. In some embodiments, a plurality of wheels are disposed on a lower side of the housing. In other embodiments, the plurality of wheels comprise a brake thereon, the brake configured to prevent the plurality of wheels from rotating when actuated.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
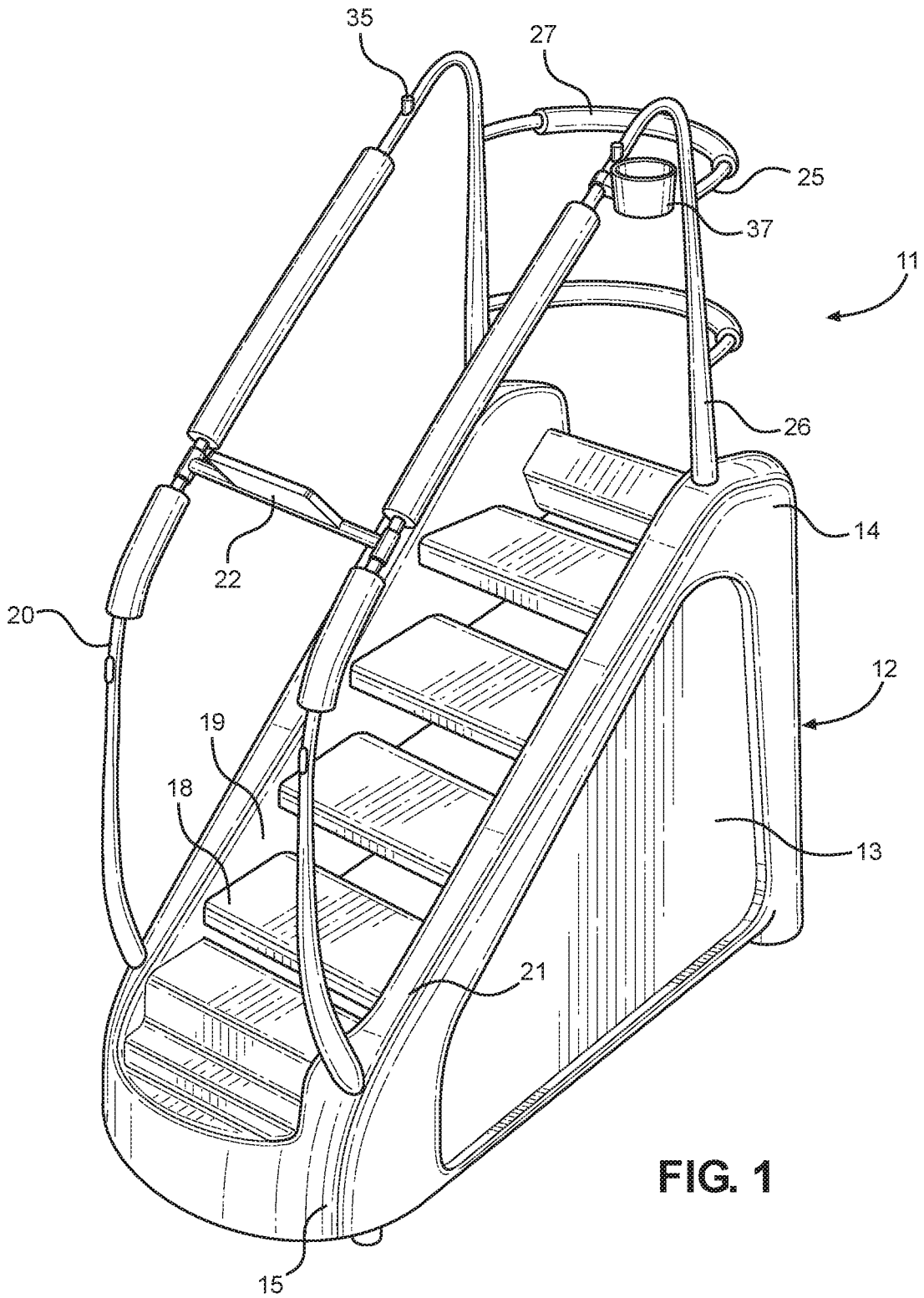
FIG. 1 shows a perspective view of an embodiment of the exercise device.

Reference is made herein to the attached drawings. Like reference numerals are used throughout the drawings to depict like or similar elements of the exercise device. The figures are intended for representative purposes only and should not be considered to be limiting in any respect.

Referring now to FIG. 1, there is shown a perspective view of an embodiment of the exercise device. The exercise device 11 comprises a housing 12 having a front side 14, a rear side 15, and a pair of sidewalls 13 extending therebetween. The rear side 15 comprises a height greater than the front side 14, such that the housing 12 comprises an angled upper side 19 extending therebetween. A plurality of steps 18 are disposed within the housing 12 such that the plurality of steps 18 extend through the housing 12 along the upper side 19 thereof. In this way, the housing 12 is configured to emulate the slope of a standard staircase, allowing a user to utilize the exercise device 11 to descend a simulated staircase.

A pair of rails 20 extend away from an upper side 21 of the pair of sidewalls 13. In the illustrated embodiment, the pair of rails 20 comprise an arcuate shape, the pair of rails 20 dimensioned to provide the user with a gripping surface when the exercise device 11 is in use. The pair of rails 20 follow the slope of the pair of sidewalls 13 such that a rear end 26 of each of the pair of rails 20 is disposed at a greater height than an opposing end thereof. In this way, the pair of rails 20 are disposed at a same height relative to a user's position along the plurality of steps 18. An arm 22 extends between the pair of rails 20, wherein the arm 22 is pivotally secured to one of the pair of rails 20. This allows the user to easily move the arm 22 between a raised position and a lowered position, such that the user can climb onto the plurality of steps 18 in order to use the exercise device 11. In the illustrated embodiment, the exercise device 11 further comprises at least one safety rail 25 extending from the rear end 26 of the pair of rails 20. The safety rail 25 is configured to prevent a user from falling from the rear side 14 of the exercise device 11 during use, should the user fail to keep up with the rate of rotation of the plurality of steps 18. In the illustrated embodiment, the safety rail 25 comprises an arcuate shape configured to comfortably surround the user, thereby minimizing discomfort for the user while ensuring that the user is fully supported thereby. In this way, the risk of the user falling from the exercise device 11 during use is minimized. In the illustrated embodiment, each of the pair of rails 20 and the safety rail 25 comprises a padded covering 27 thereon, wherein the padded covering 27 is configured to provide a comfortable gripping surface for the user while also distributing any forces due to impact therealong. In this way, should a user fall against the safety rail 25, the force of the fall is reduced to prevent injury to the user. In the illustrated embodiment, a gap is formed along the padded covering 27 of the pair of rails 20, wherein the gap allows the arm 22 to pivot about and secure to the pair of rails 20.

Figure 3A:
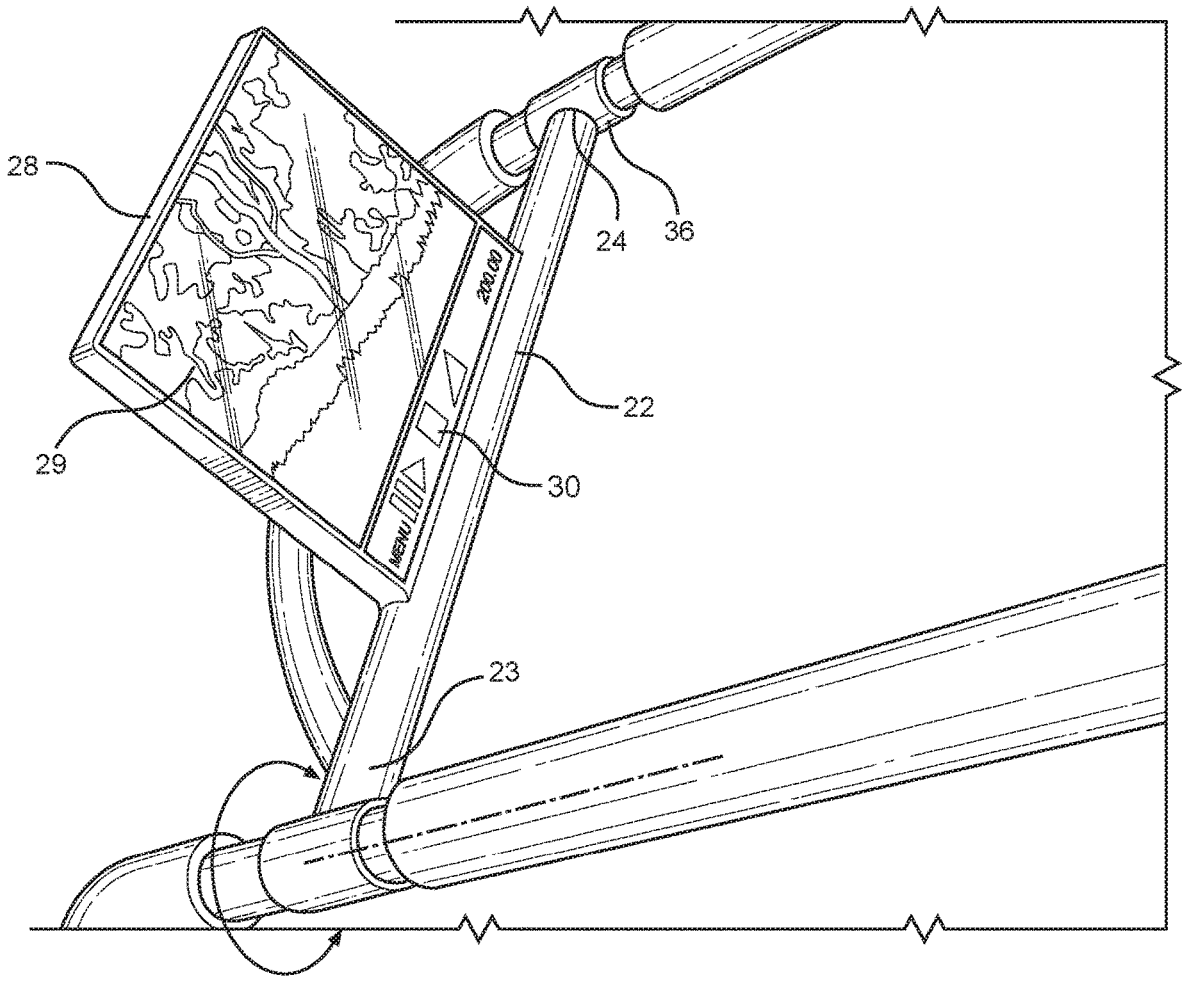
FIG. 3A shows a perspective view of the arm and computer of an embodiment of the exercise device in a lowered position.

In some embodiments, the pair of rails 20 comprise a heartrate sensor therein, wherein the heartrate sensor is configured to detect a user's heartrate when the user grasps the pair of rails 20. The heartrate can then be displayed on a display (as shown in FIG. 3A, 29). In this way, the user can easily monitor their heartrate to ensure that a correct level of activity is maintained throughout use of the exercise device 11. In the illustrated embodiment, the pair of rails 20 further comprise an emergency stop button 35 thereon. The emergency stop button 35 is configured to immediately stop the rotation of the plurality of steps 18 upon the actuation of the emergency stop button 35. In this way, the user can immediately stop the plurality of steps 18 if the user cannot keep up with the rate of rotation thereof, thereby preventing injury. In the illustrated embodiment, the emergency stop button 35 is disposed on opposing ends of each of the pair of rails 20, such that an emergency stop button 35 is always in easy reach of the user, should the user fall. In the illustrated embodiment, the exercise device 11 further comprises a container 37 removably securable to one of the pair of rails 20, wherein the container 37 is configured to receive a beverage container therein. In this way, the user can place a beverage within easy reach during exercise, allowing the user to hydrate themselves. In the illustrated embodiment, the container 37 comprises a cylindrical cross-section, however alternative cross sections are contemplated. In the illustrated embodiment, the container 37 is secured to the pair of rails 20 by a C-shaped clamp via friction fit.

Figure 2:
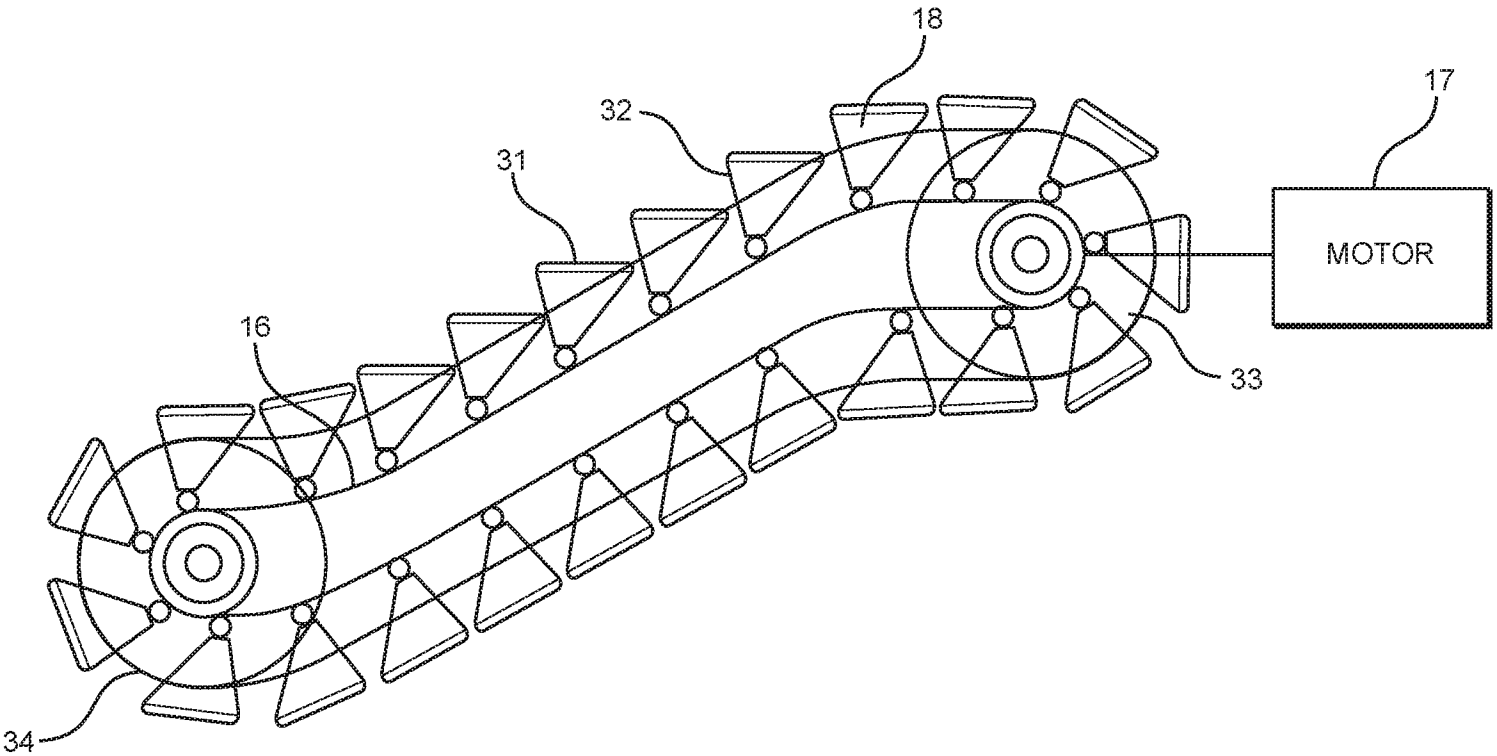
FIG. 2 shows a side view of the belt system of an embodiment of the exercise device.

Referring now to FIG. 2, there is shown a side view of the belt system an embodiment of the exercise device. The plurality of steps 18 are affixed to a belt 16, wherein the belt 16 is operably connected to a motor 17. In the illustrated embodiment, the motor 17 is disposed within the housing. The motor 17 is configured to rotate the belt 16 within the housing, such that the plurality of steps 18 rotated within the housing, similar to the movement of an escalator. The belt 16 is driven by a pair of gears disposed at a first end 33 of the belt 16 and a second end 34 of the belt 16. The first end 33 is disposed at a greater height than the second end 34, such that the belt 16 is disposed at an angle configured to replicate the angle of a typical staircase. As the belt 16 rotates, the plurality of steps 18 are rotated about the belt 16, wherein the plurality of steps 18 rotate about the first and second ends 33, 34 such that the plurality of steps 18 recede into the housing at the first end 33 and extend through the housing at the second end 34. In this way, as the plurality of steps 18 rotate about the housing, the plurality of steps 18 create an endless staircase similar to an escalator, allowing a user to continuously descend the plurality of steps 18 for a desired amount of time to attain a desired activity level for exercise.

In the illustrated embodiment, each of the plurality of steps comprises a front wall 32 and an upper surface 31, wherein the upper surface 31 is configured to receive the weight of a user thereagainst. The upper surface 31 of each of the steps 18 extending through the upper side of the housing is configured to rest along parallel planes separated by a regular height interval, such that the plurality of steps 18 extending from the housing are representative of a typical staircase. In this way, every time the user descends a step 18, the height a user's foot must travel is consistent. This provides even and consistent energy usage, while also minimizing the risk of falling due to varying height differences between steps 18. In some embodiments, the front wall 32 extends perpendicularly away from the upper surface 31, such that the front wall 32 abuts an adjacent step 18. In this way, the plurality of steps 18 form a complete staircase, preventing access to an interior of the housing, thereby minimizing the risk of injury due to falling, tripping, or placing a body part into the housing. Should the user have access to the interior of the housing, the user could easily get trapped and severely injured as the belt 16 continues to rotate. In the illustrated embodiment, the front wall 32 extends away from the upper surface 31 at an acute angle. In this way, the volume of each individual step 18 is decreased, thereby decreasing the overall weight of the exercise device, allowing a user to more easily transport the exercise device to a desired location.

Figure 3B:
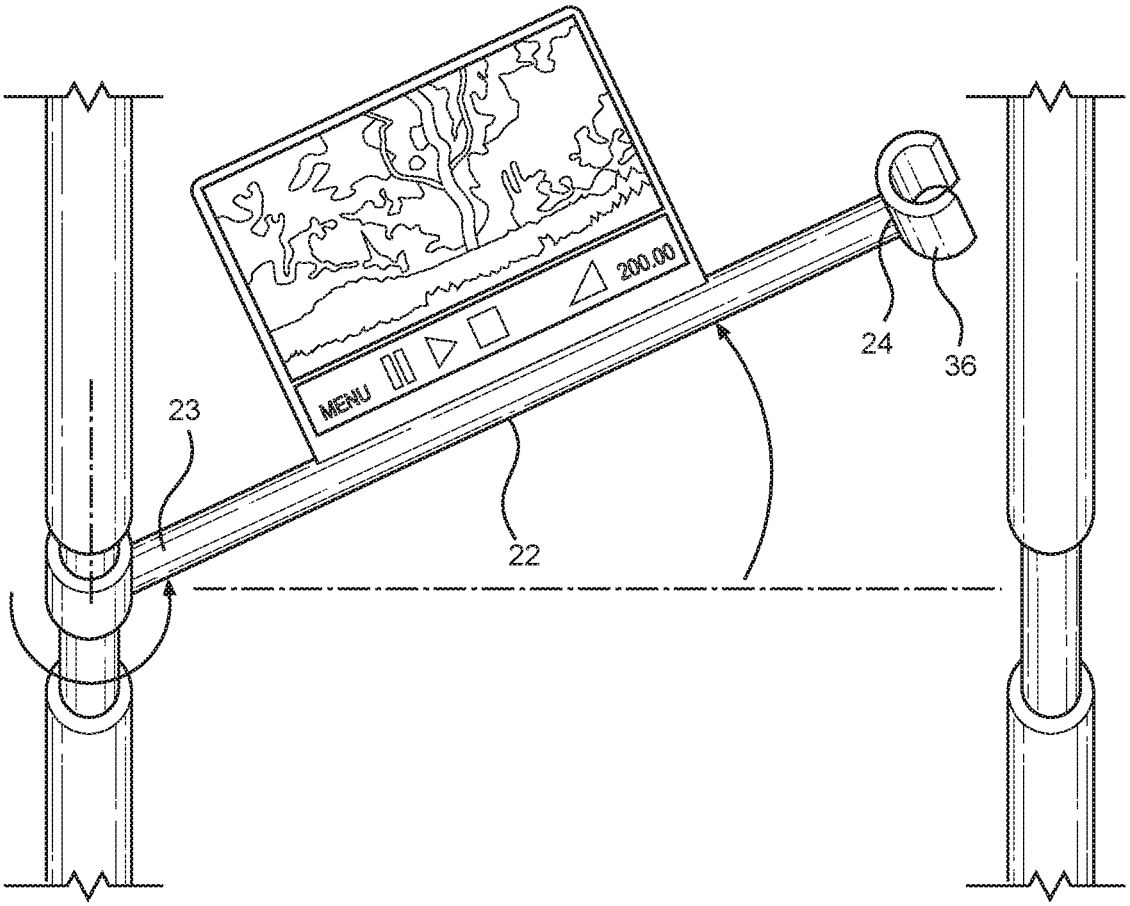
FIG. 3B shows a perspective view of the arm and computer of an embodiment of the exercise device in a raised position.

Referring now to FIGS. 3A and 3B, there is shown a perspective view of the arm and computer of an embodiment of the exercise device in a lowered position and a perspective view of the arm and computer of an embodiment of the exercise device in a raised position, respectively. In the illustrated embodiments, the arm 22 extends perpendicularly between the pair of rails, wherein a proximal end 23 of the arm 22 is pivotally secured to one of the pair of rails. A distal end 24 of the arm 22 is removably securable to an opposing rail, such that the arm 22 can selectively move between a raised position and a lowered position, wherein the raised position the distal end 24 is positioned away from the opposing rail, creating an opening that the user can pass through. In this way, the user can enter and exit the exercise device, the arm 22 serving to prevent the user from descending the plurality of steps past the arm 22. A pneumatic dampening system is disposed about the proximal end of the arm 22, the dampening system configured to slow the rate of descent of the arm 22 from the raised position to the lowered position. In this way, the arm 22 is prevented from falling at the rate of acceleration due to gravity, thereby reducing the risk of injury from the arm 22 falling upon the user as well as reducing the risk of damage to the arm 22. In the illustrated embodiment, the arm 22 is configured to removably secure to the opposing rail via a C-shaped clamp 36 disposed on the distal end 24 of the arm 22. The C-shaped clamp 36 is configured to frictionally engage the opposing rail, thereby securing the arm 22 in the lowered position.

In the illustrated embodiment, a computer 28 is affixed to the arm 22, wherein the computer comprises a display 29 and controls 30 thereon. The computer 28 is operably connected to the motor, such that the user can alter the rate of rotation of the belt via the controls 30. In this way, the user can easily alter the difficulty or intensity of the workout by altering the rate of rotation of the belt, as at higher rates of rotation, the user must descend a greater number of steps. The computer 28 can further calculate and display various information related to the exercise, such as energy expended by the user, (i.e., calories burned), duration of exercise, current heartrate of the user, current intensity level or rate of rotation of the belt and the like. In this way, the user can easily monitor their exercise progress on the display 29, such that the user can ensure that desired exercise goals are met.

Figure 4:
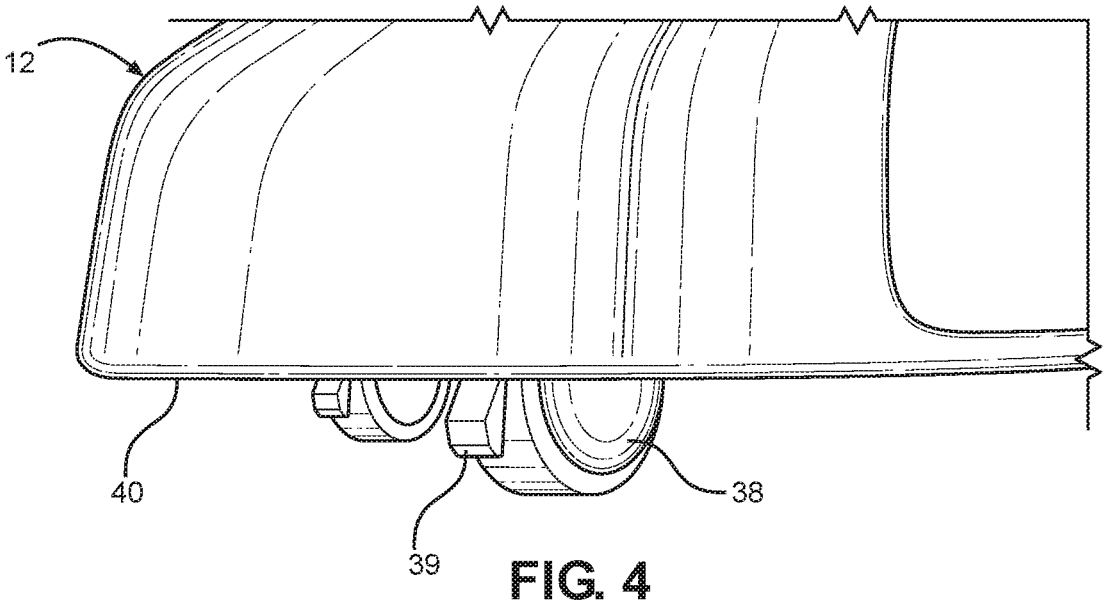
FIG. 4 shows a perspective view of the plurality of wheels of an embodiment of the exercise device.

Referring now to FIG. 4, there is shown a perspective view of the plurality of wheels of an embodiment of the exercise device. In the illustrated embodiment, the exercise device further comprises a plurality of wheels 38 disposed along a lower side 40 of the housing 12. The plurality of wheels 38 can comprise wheels, castors, or the like. In some embodiments, the plurality of wheels 38 are pivotally affixed to the lower side 40 such that the plurality of wheels 38 can rotate to provide increase maneuverability to the exercise device. In this way, the user can easily move the exercise device to a desired location, while allowing the exercise device to easily navigate corners or other obstructions. In the illustrated embodiment, the plurality of wheels 38 further comprise a brake 39 thereon, the brake 39 configured to prevent the rotation of each of the plurality of wheels 38 when actuated. In this way, the user can secure the exercise device in a desired location, thereby preventing the exercise device from moving during use. This lowers the risk of injury due to the housing 12 shifting while the user is exercising.

In one exemplary use, the user can position the exercise device in a desired location and engage the brake, such that the plurality of wheels do not rotate while the exercise device is in use. The user then moves the arm to the raised position, allowing the user to climb onto the plurality of steps extending through the upper side of the housing. The arm is then lowered and secured to one of the pair of rails. The user can then activate the motor via the controls, rotating the belt and the affixed plurality of steps at a desired rate of rotation. The user can then descend the plurality of steps as they rotate, allowing the user to engage in a low impact exercise crucial for recovery after several types of injury. The user constrained within the operable portion of the exercise device by the arm, and in some embodiments, but the safety rail at a rear end of the rails. The user can monitor their exercise progress via the display on the arm, wherein the display can show data relevant to the current exercise, such as duration, calories burned, current intensity, and the like. Should the user fall, or otherwise risk injury, the user can actuate one of several emergency stop buttons disposed on the rails to immediately stop the motor. When finished exercising, the user can raise the arm and climb down from the plurality of steps to exit the exercise device.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise device, comprising:

a housing having a front side, a rear side, and a pair of sidewalls extending therebetween;

wherein the rear side comprises a greater height than the front side;

a belt disposed within the housing, wherein the belt is operably connected to a motor;

wherein the motor is configured to rotate the belt within the housing;

a plurality of steps affixed to the belt, wherein the plurality of steps extend through the housing along an upper side thereof;

a pair of rails, each extending from an upper end of one of the pair of sidewalls, wherein the pair of rails are configured to provide a gripping surface;

an arm pivotably affixed to one of the pair of rails at a proximal end thereof, wherein a distal end of the arm is removably securable to an opposing rail;

wherein rotation of the arm about the proximal end is dampened by pneumatic pressure.

2. The exercise device of claim 1, wherein at least one safety rail extends between the pair of rails at a rear end thereof.

3. The exercise device of claim 2, wherein the safety rail comprises an arcuate shape.

4. The exercise device of claim 2, wherein the safety rail comprises a padded covering thereon.

5. The exercise device of claim 1, wherein each of the pair of rails comprises a padded covering thereon.

6. The exercise device of claim 1, wherein a computer is disposed on the arm, the computer having a display and controls thereon, the controls configured to adjust the rate at which the belt rotates.

7. The exercise device of claim 6, wherein the display faces the rear side of the housing.

8. The exercise device of claim 1, wherein each of the plurality of steps comprise an upper surface and a front wall, wherein the front wall extends perpendicularly between the upper surface of one of the plurality of steps towards the upper surface of an adjacent step.

9. The exercise device of claim 1, wherein an upper surface of each of the plurality of steps is disposed at a different height when the plurality of steps are exposed from the housing.

10. The exercise device of claim 1, wherein a first end of the belt is disposed at a height greater than a second end of the belt.

11. The exercise device of claim 1, wherein each of the pair of rails comprises an emergency stop button disposed on opposing ends of each of the pair of rails, wherein the emergency stop button is configured to stop the rotation of the belt when the emergency stop button is actuated.

12. The exercise device of claim 1, wherein the distal end of the arm comprises a C-shaped clamp configured to removably secure to one of the pair of rails via friction fit.

13. The exercise device of claim 1, wherein a container is removably securable to the pair of rails, wherein the container is configured to receive a beverage container therein.

14. The exercise device of claim 1, wherein a heartrate sensor is disposed within the pair of rails, the heartrate sensor configured to detect a heartrate of a user gripping the rail, wherein the heartrate is then displayed on the display.

15. The exercise device of claim 1, wherein a plurality of wheels are disposed on a lower side of the housing.

16. The exercise device of claim 1, wherein the plurality of wheels further comprise a brake thereon, the brake configured to prevent the plurality of wheels from rotating when actuated.

17. The exercise device of claim 1, wherein the arm is disposed towards the front side of the housing, such that a linear distance between the arm and the front side is less than a linear distance between the arm and the rear side.

* * * * *